US005480058A

United States Patent [19]

Hutchins

[11] Patent Number: 5,480,058

[45] Date of Patent: Jan. 2, 1996

[54] MULTI-PURPOSE FOLD-DOWN UTILITY TRAY

[76] Inventor: Robert D. Hutchins, R.D. #1, Box 1056, Vergennes, Vt. 05491

[21] Appl. No.: 360,165

[22] Filed: Dec. 20, 1994

[51] Int. Cl.[6] ..... A47B 5/04

[52] U.S. Cl. ..... 220/478; 206/549; 224/282; 248/205.3

[58] Field of Search ..... 206/541, 542, 206/549, 564; 220/476, 478, 480; 224/275, 282, 545, 553, 555; 248/205.3

[56] References Cited

U.S. PATENT DOCUMENTS

| | | | |
|---|---|---|---|
| 1,742,822 | 1/1930 | Olson | 224/275 |
| 3,338,629 | 8/1967 | Drees | 224/275 |
| 3,690,446 | 9/1972 | Spainhour et al. | 224/275 |
| 4,466,659 | 8/1984 | Carpentier et al. | 224/275 |

FOREIGN PATENT DOCUMENTS

| | | | |
|---|---|---|---|
| 558009 | 5/1958 | Canada | 220/480 |
| 2029346 | 3/1980 | United Kingdom | 224/275 |

*Primary Examiner*—Jimmy G. Foster

[57] ABSTRACT

A new and improved multi-purpose fold-down utility tray comprised of an upper panel having a hook and loop type fastener patch secured thereon. A plurality of adhesive strips are secured to the upper panel. The adhesive strips serve to secure the upper panel to a wall or flat surface. A lower panel is hingedly secured to the upper panel. The lower panel has a plurality of recessed compartments formed therein. The lower panel has a hook and loop type fastener secured thereon. The hook and loop type fastener cooperates with the hook and loop type fastener of the upper panel in a closed configuration. Contained in the device are two cords. Each of the two cords is secured to the upper panel and secured to the lower panel. The two cords serve to support the lower panel in a position perpendicular to the upper panel in an open configuration.

5 Claims, 4 Drawing Sheets

MULTI-PURPOSE FOLD-DOWN UTILITY TRAY

BACKGROUND OF THE INVENTION

1. Field of the Invention

The present invention relates to a multi-purpose fold-down utility tray and more particularly pertains to folding down to allow for a variety of purposes with a multi-purpose fold-down utility tray.

2. Description of the Prior Art

The use of folding trays is known in the prior art. More specifically, folding trays heretofore devised and utilized for the purpose of supporting food and beverages are known to consist basically of familiar, expected and obvious structural configurations, notwithstanding the myriad of designs encompassed by the crowded prior art which have been developed for the fulfillment of countless objectives and requirements.

By way of example, Hood, Jr. U.S. Pat. No. 5,127,339, discloses a foldable lap tray.

Shu U.S. Pat. No. Des. 322,163 discloses the ornamental design for a folding tray for vehicles.

Kramer et al. U.S. Pat. No. 5,046,433 discloses an adjustable folding tray apparatus for attachment to a vehicle seat back.

Goings U.S. Pat. No. 3,638,849 discloses a folding plastic tray.

Rosner U.S. Pat. No. 3,625,161 discloses a folding tray.

While these devices fulfill their respective, particular objective and requirements, the aforementioned patents do not describe a multi-purpose fold-down utility tray for folding down to allow for a variety of purposes.

In this respect, the multi-purpose fold-down utility tray according to the present invention substantially departs from the conventional concepts and designs of the prior art, and in doing so provides an apparatus primarily developed for the purpose of folding down to allow for a variety of purposes.

Therefore, it can be appreciated that there exists a continuing need for new and improved multi-purpose fold-down utility tray which can be used for folding down to allow for a variety of purposes. In this regard, the present invention substantially fulfills this need.

SUMMARY OF THE INVENTION

In the view of the foregoing disadvantages inherent in the known types of folding trays now present in the prior art, the present invention provides an improved multi-purpose fold-down utility tray. As such, the general purpose of the present invention, which will be described subsequently in greater detail, is to provide a new and improved multi-purpose fold-down utility tray and method which has all the advantages of the prior art and none of the disadvantages.

To attain this, the present invention essentially comprises a rectangular upper panel having an upper edge, a lower edge, two side edges, an interior surface, and an exterior surface. The interior surface has a hook and loop type fastener patch secured inwardly of the upper edge. The interior surface has a recess formed therein inwardly of each of the two side edges. A plurality of adhesive strips are secured to the exterior surface of the rectangular upper panel. The adhesive strips have removable protective covers thereon. The adhesive strips serve to secure the upper panel to a wall or flat surface. The device contains a rectangular lower panel having an upper edge, a lower edge, two side edges, an interior surface, and an exterior surface. The upper edge is hingedly secured to the lower edge of the upper panel. The interior surface has a plurality of recessed compartments formed therein. The interior surface has a hook and loop type fastener secured inwardly of the lower edge. The hook and loop type fastener cooperates with the hook and loop type fastener of the upper panel when the lower edge is folded upwardly to abut the upper edge of the upper panel in a closed configuration. The device contains two cords. Each of the two cords has a first end and a second end. Each first end has a strap theresecured. Each strap is secured to the two side edges of the upper panel adjacent the recess formed inwardly thereof by a rivet. Each second end has a strap theresecured. Each strap is secured to the two side edges of the lower panel by a rivet. The two cords serve to support the lower panel in a position perpendicular to the upper panel in an open configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-purpose fold-down utility tray which has all the advantages of the prior art folding trays and none of the disadvantages.

It is another object of the present invention to provide a new and improved multi-purpose fold-down utility tray which may be easily and efficiently manufactured and marketed.

It is a further object of the present invention to provide a new and improved multi-purpose fold-down utility tray which is of durable and reliable construction.

An even further object of the present invention is to provide a new and improved multi-purpose fold-down utility tray which is susceptible of a low cost of manufacture with regard to both materials and labor, and which accordingly is then susceptible of low prices of sale to the consuming public, thereby making such a multi-purpose fold-down utility tray economically available to the buying public.

Still yet another object of the present invention is to provide a new and improved multi-purpose fold-down utility tray which provides in the apparatuses and methods of the prior art some of the advantages thereof, while simultaneously overcoming some of the disadvantages normally associated therewith.

Even still another object of the present invention is to provide a new and improved multi-purpose fold-down utility tray for folding down to allow for a variety of purposes.

Lastly, it is an object of the present invention to provide a new and improved multi-purpose fold-down utility tray comprised of an upper panel having a hook and loop type fastener patch secured thereon. A plurality of adhesive strips are secured to the upper panel. The adhesive strips serve to secure the upper panel to a wall or flat surface. A lower panel is hingedly secured to the upper panel. The lower panel has a plurality of recessed compartments formed therein. The lower panel has a hook and loop type fastener secured thereon. The hook and loop type fastener cooperates with the hook and loop type fastener of the upper panel in a closed configuration. Contained in the device are two cords. Each of the two cords is secured to the upper panel and secured to the lower panel. The two cords serve to support the lower panel in a position perpendicular to the upper panel in an open configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
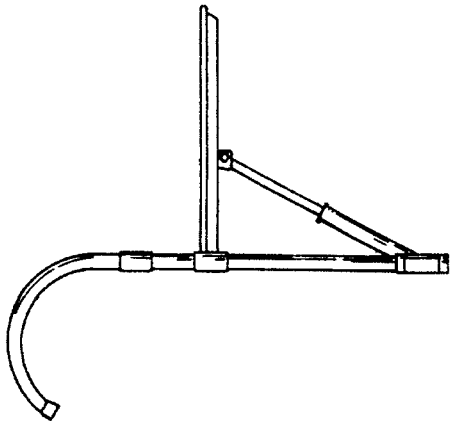
PRIOR ART FIG. 2
FIG. 2 is a side elevation view of the prior art folding tray.
Figure 1:
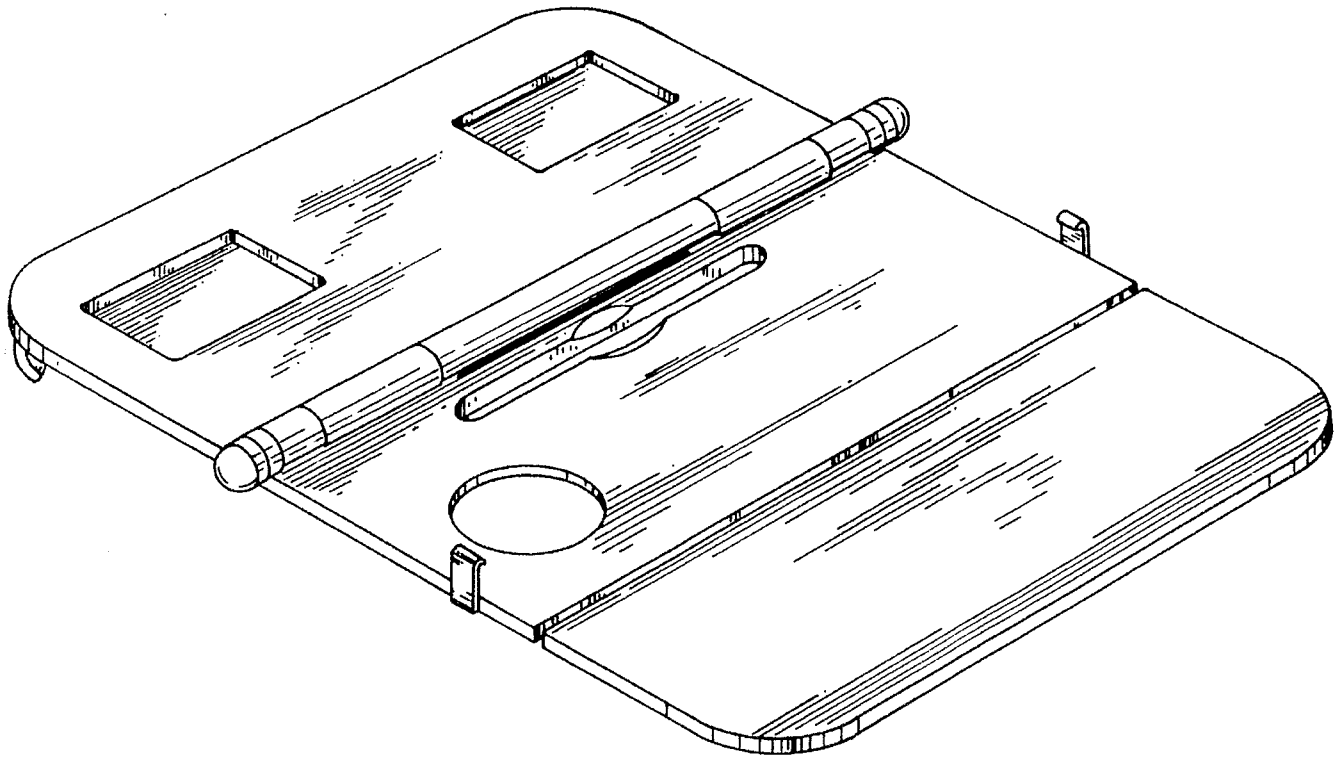
PRIOR ART FIG. 1
FIG. 1 is a perspective view of the prior art folding tray for vehicles.
Figure 3:
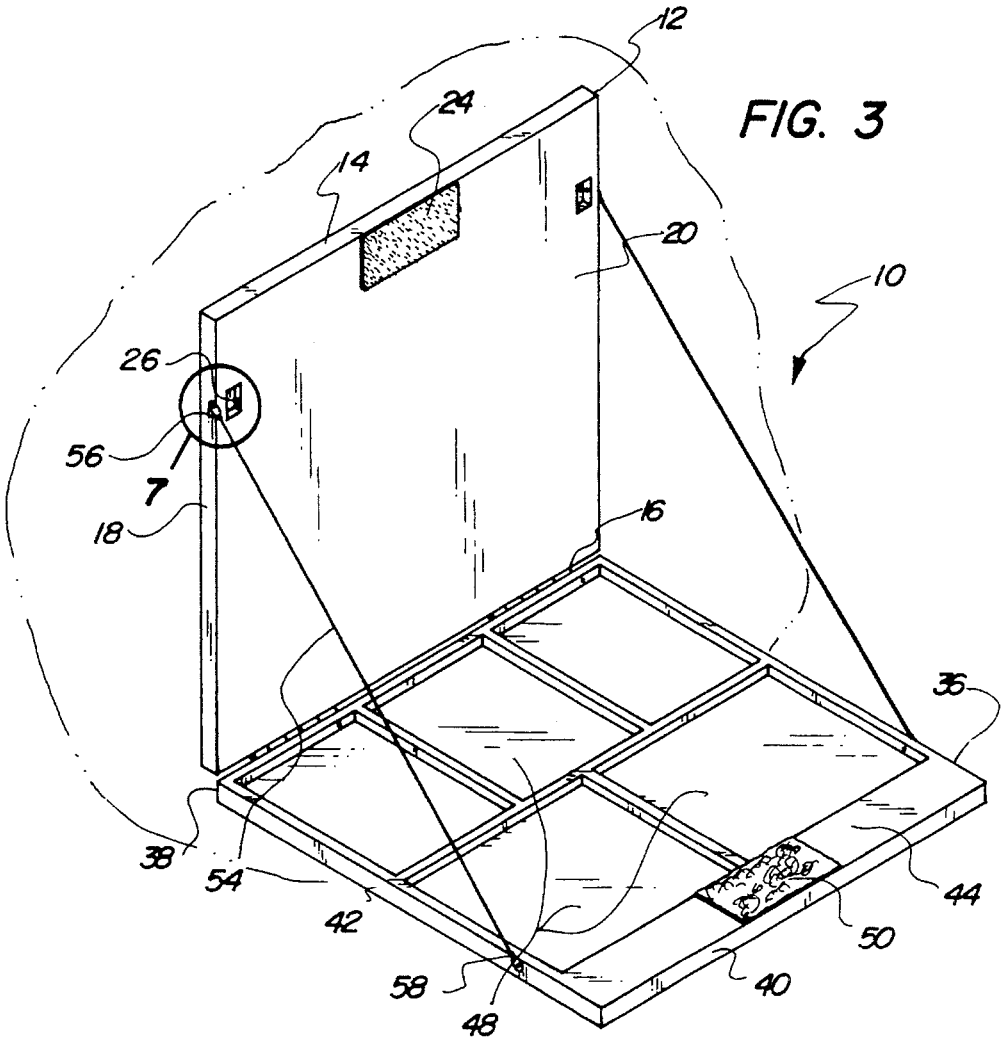
FIG. 3 is a perspective view of the preferred embodiment of the multi-purpose fold-down utility tray constructed in accordance with the principles of the present invention.

With reference now to the drawings, and in particular, to FIG. 3 thereof, the preferred embodiment of the new and improved multi-purpose fold-down utility tray embodying the principles and concepts of the present invention and generally designated by the reference number 10 will be described.

Specifically, it will be noted in the various Figures that the device relates to a new and improved multi-purpose fold-down utility tray for folding down to allow for a variety of purposes. In its broadest context, the device consists of a rectangular upper panel, a plurality of adhesive strips, a rectangular lower panel, and two cords.

The device 10 contains a rectangular upper panel 12 having an upper edge 14, a lower edge 16, two side edges 18, an interior surface 20, and an exterior surface 22. The interior surface 20 has a hook and loop type fastener patch 24 secured inwardly of the upper edge 14. The interior surface 20 has a recess 26 formed therein inwardly of each of the two side edges 18. The upper panel 12 is preferably fabricated of a molded plastic.

Figure 6:
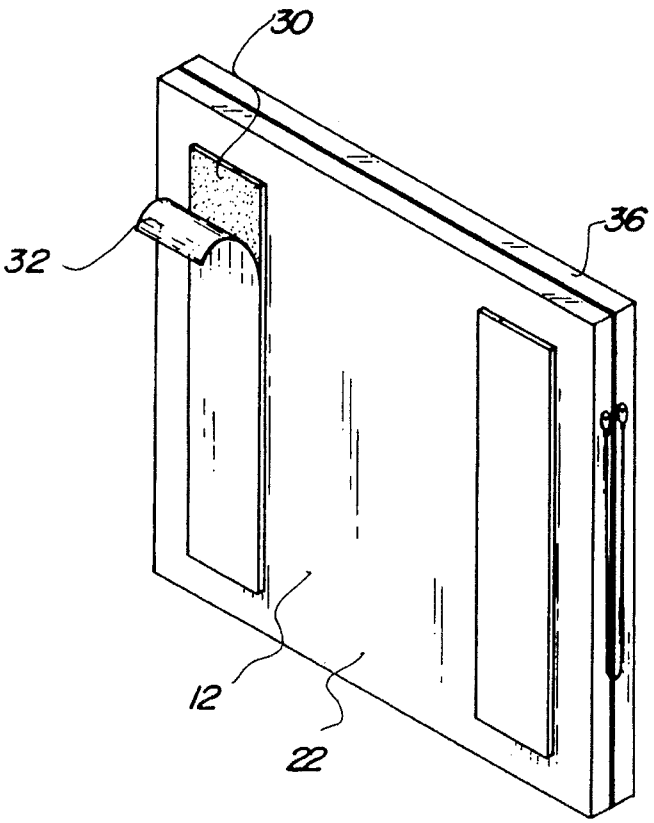
FIG. 6 is a rear elevation view of the present invention in the closed configuration.

As best illustrated in FIG. 6, a plurality of adhesive strips 30 are secured to the exterior surface 22 of the rectangular upper panel 12. The adhesive strips 30 have removable protective covers 32 thereon. The adhesive strips 30 serve to secure the upper panel 12 to a wall or flat surface. The preferred number of adhesive strips is two, but need not be limited to this particular amount.

Figure 5:
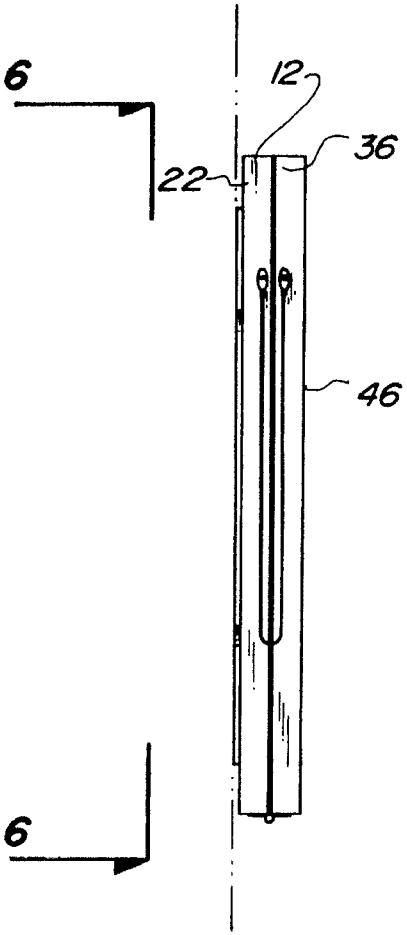
FIG. 5 is a side elevation view of the present invention in a closed configuration.

The device 10 contains a rectangular lower panel 36 having an upper edge 38, a lower edge 40, two side edges 42, an interior surface 44, and an exterior surface 46. The upper edge 38 is hingedly secured to the lower edge 16 of the upper panel 12. The interior surface 44 has a plurality of recessed compartments 48 formed therein. The plurality of recessed compartments can be used to hold and separate food and beverage products. The interior surface 44 has a hook and loop type fastener 50 secured inwardly of the lower edge 40. The hook and loop type fastener 50 cooperates with the hook and loop type fastener 24 of the upper panel 12 when the lower edge 40 is folded upwardly to abut the upper edge 14 of the upper panel 12 in a closed configuration as illustrated in FIG. 5.

Figure 4:
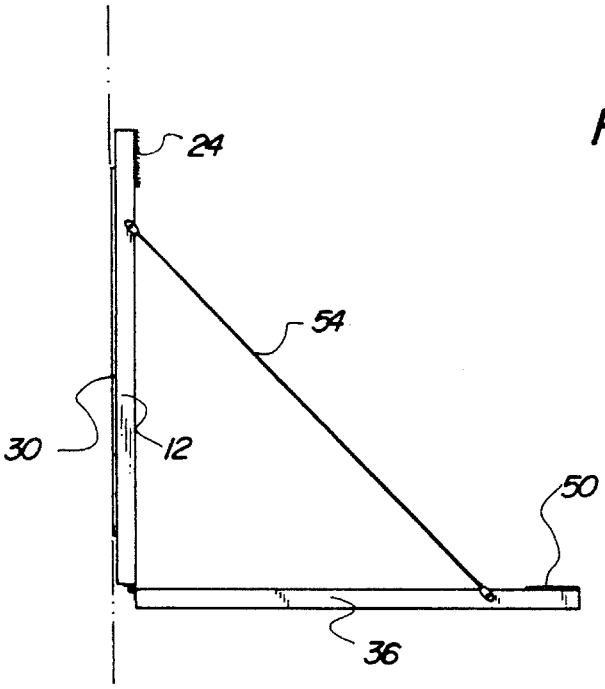
FIG. 4 is a side elevation view of the present invention in an open configuration.
Figure 8:
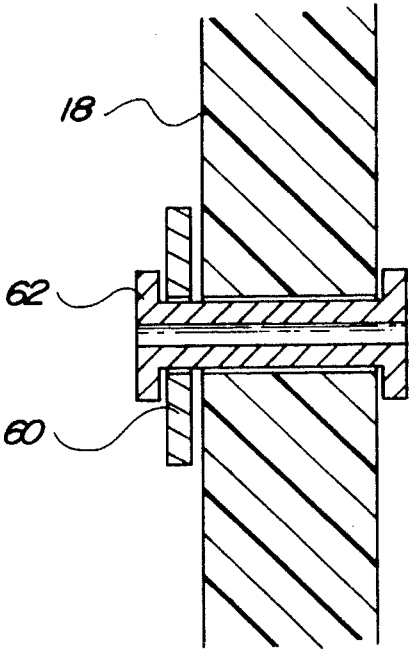
FIG. 8 is a cross-sectional view as taken along line 8—8 of FIG. 7.
Figure 7:
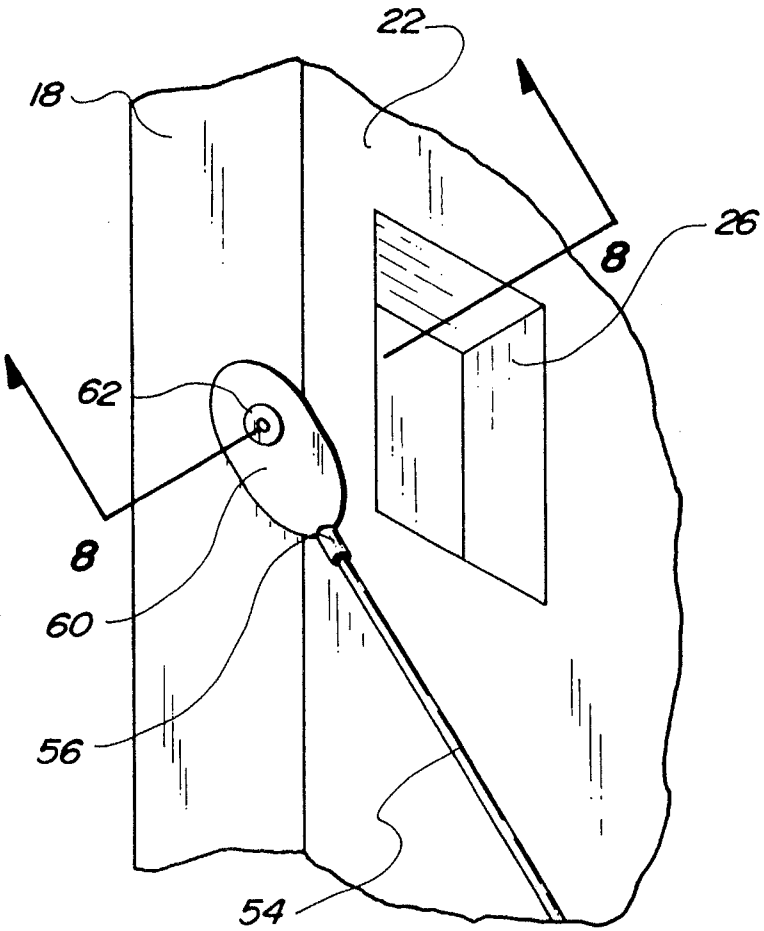
FIG. 7 is an enlarged sectional view of the cord attachment to the upper panel.

The device 10 contains two cords 54. Each of the two cords 54 has a first end 56 and a second end 58. Each first end 56 has a strap 60 theresecured. Each strap 60 is secured to the two side edges 18 of the upper panel 12 adjacent the recess 26 formed inwardly thereof by a rivet 62 as best illustrated in FIG. 7 and FIG. 8. Each second end 58 has a strap 60 theresecured. Each strap 60 is secured to the two side edges 42 of the lower panel 36 by a rivet 62. The two cords 54 serve to support the lower panel 36 in a position perpendicular to the upper panel 12 in an open configuration as illustrated in FIG. 4.

The present invention is a fold-down tray which can be mounted on any flat, vertically oriented surface and used for a variety of purposes.

It is simply comprised of two plastic panels and associated hardware. Each panel is twelve inches square and one half of one inch in thickness, and they are joined by hinges along one edge. When folded to the closed position, the panels are aligned and abut each other. Two patches of hook and loop material are affixed to the panels—one at the midpoint of each of the abutting surfaces along its outboard interior edge. Strips of self-adhesive material, with a peel-off protective covering, are affixed to the outer surface of one panel. Two sturdy strings or cords complete the assembly, and these are attached to the edges of each panel near the end opposite the hinges. The length of these cords is such that the panels will be perpendicular to each other when rotated in a diverging direction.

One need only peel the protective facing from the adhesive strips to quickly mount one panel to any flat surface. The "tray" panel can then be lowered to a horizontal attitude or, when not in use, folded upward against its vertical counterpart to be out of the way.

This handy tray has a myriad of potential uses. It can be used as a meal tray in a recreational vehicle or automobile, or it can be used to store articles in shops, office areas, in the home, on a work bench or in a hobby work area. The applications are limited only by the imagination.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved multi-purpose fold-down utility tray for folding down to allow for a variety of purposes comprising, in combination:

a rectangular upper panel having an upper edge, a lower edge, two side edges, an interior surface, and an exterior surface, the interior surface having a hook and loop type fastener patch secured inwardly of the upper edge, the interior surface having a recess formed therein inwardly of each of the two side edges;

a plurality of adhesive strips secured to the exterior surface of the rectangular upper panel, the adhesive strips having removable protective covers thereon, the adhesive strips serving to secure the upper panel to a wall or flat surface;

a rectangular lower panel having an upper edge, a lower edge, two side edges, an interior surface, and an exterior surface, the upper edge hingedly secured to the lower edge of the upper panel, the interior surface having a plurality of recessed compartments formed therein, the interior surface having a hook and loop type fastener secured inwardly of the lower edge, the hook and loop type fastener cooperating with the hook and loop type fastener of the upper panel when the lower edge is folded upwardly to abut the upper edge of the upper panel in a closed configuration;

two cords, each of the two cords having a first end and a second end, each first end having a strap theresecured, each strap secured to the two side edges of the upper panel adjacent the recess formed inwardly thereof by a rivet, each second end having a strap theresecured, each strap secured to the two side edges of the lower panel by a rivet, the two cords serving to support the lower panel in a position perpendicular to the upper panel in an open configuration.

2. A new and improved multi-purpose fold-down utility tray for folding down to allow for a variety of purposes comprising, in combination:

an upper panel having a hook and loop type fastener patch secured thereon;

a plurality of adhesive strips secured to the upper panel, the adhesive strips serving to secure the upper panel to a wall or flat surface;

a lower panel hingedly secured to the upper panel, the lower panel having a plurality of recessed compartments formed therein, the lower panel having a hook and loop type fastener secured thereon, the hook and loop type fastener cooperating with the hook and loop type fastener of the upper panel in a closed configuration;

two cords, each of the two cords secured to the upper panel and secured to the lower panel, the two cords serving to support the lower panel in a position perpendicular to the upper panel in an open configuration.

3. The tray as described in claim 2 and further including wherein the upper panel having a recess formed inwardly of outer edge portions thereof.

4. The tray as described in claim 3 and further including wherein the cords are secured to the upper panel by a rivet extending through the recess formed therein.

5. The tray as described in claim 1 and further including wherein the rectangular upper panel and the rectangular panel are fabricated of molded plastic.

* * * * *